US005242175A

United States Patent [19]

O'Leary

[11] Patent Number: 5,242,175

[45] Date of Patent: Sep. 7, 1993

[54] ELASTIC ACTION GAME DEVICE

[76] Inventor: Tara A. O'Leary, 3326 Ramblewood La., Rockford, Ill. 61111

[21] Appl. No.: 810,711

[22] Filed: Dec. 18, 1991

[51] Int. Cl.[5] ..... A63B 67/00

[52] U.S. Cl. ..... 273/440; 24/129 D; 273/459

[58] Field of Search ..... 273/440, 451, 459; 24/17 B, 129 D, 300; 206/805; 482/77, 78, 92; 124/17, 18

[56] References Cited

U.S. PATENT DOCUMENTS

| | | | |
|---|---|---|---|
| 620,664 | 3/1899 | Nissam | 24/17 B |
| 3,069,162 | 12/1962 | Samuel | 273/451 X |
| 3,460,828 | 8/1969 | Curlee | 472/135 X |
| 3,588,098 | 6/1971 | Stewart | 472/134 |
| 3,730,518 | 5/1973 | Drapcho | 472/137 |
| 4,077,625 | 3/1978 | Clarke | 482/92 |
| 4,158,250 | 6/1979 | Ringwald | 206/805 |

*Primary Examiner*—William H. Grieb
*Attorney, Agent, or Firm*—Margaret Marsh Parker

[57] ABSTRACT

A game device consisting of a large band of very strong and highly elastic material which is supported in use by the torsos of the players. When a player (or players) leaves his or her position against the band and dashes across and into another portion of the band, the force of the body's impact causes other players to be propelled across the band, repeating the sequence for a specified time period or indefinitely. No other pieces of equipment are required for the game, and no special field layout or other construction is necessary.

7 Claims, 7 Drawing Sheets

ELASTIC ACTION GAME DEVICE

BACKGROUND OF THE INVENTION

This invention relates to the field of action game devices and, particularly, to an elastic game device for use by multiple players.

Many games have been devised for the use of groups or teams of individuals, but most have some drawback in practical applications. Most require special equipment, such as balls, bats and gloves, skates or rackets, etc. Many require permanent or semi-permanent nets or goal posts, or require a specific playing field layout. Most require some skill and/or training in order to obtain an substantial enjoyment from the game activity.

There are a number of action devices which need to be inflated before use, not always an easy job, but most are for individual use, not for a group of players.

Thus, there exists a need for a device which provides fun and substantial physical activity or exercise while requiring a minimum of equipment, which can be played almost anywhere outdoors or in a game room such as a gymnasium, and which requires essentially no training, while experience will provide an increased measure of enjoyment and challenge.

SUMMARY OF THE INVENTION

It is an object of the present invention to provide an action game device producing a maximum of fun and exercise.

It is another object to provide a simple, highly portable device requiring no permanent or semi-permanent structural setup, additional equipment or specialized playing field layout.

It is an additional object to provide such a device requiring no special skill or training to utilize and enjoy, but with which experience will add increased skill and enhanced pleasure.

These objects and others which will become apparent are obtained in the present invention by an elastic band of suitable proportions and characteristics which is easily rolled up for transportation and storage, and merely unrolled for use. The band is supported above the ground by the bodies of the game players during play. Once play has begun, the movement of the players, acting against the elasticity of the band, creates continuous and alternating weight displacement. As one or more players move, the resultant stretching and contraction of the elastic band propel other players across the contained play area and into another portion of the elastic band. The movement of the players and the elasticity of the band, therefore, provide the forces which enable the continuous game activity.

BRIEF DESCRIPTION OF THE DRAWING

FIGS. 2A–2E show schematic top views of one typical game in progress, using the band of the invention, and showing the sequence of positions momentarily attained by the players.

DETAILED DESCRIPTION OF THE PREFERRED EMBODIMENT

Figure 1:
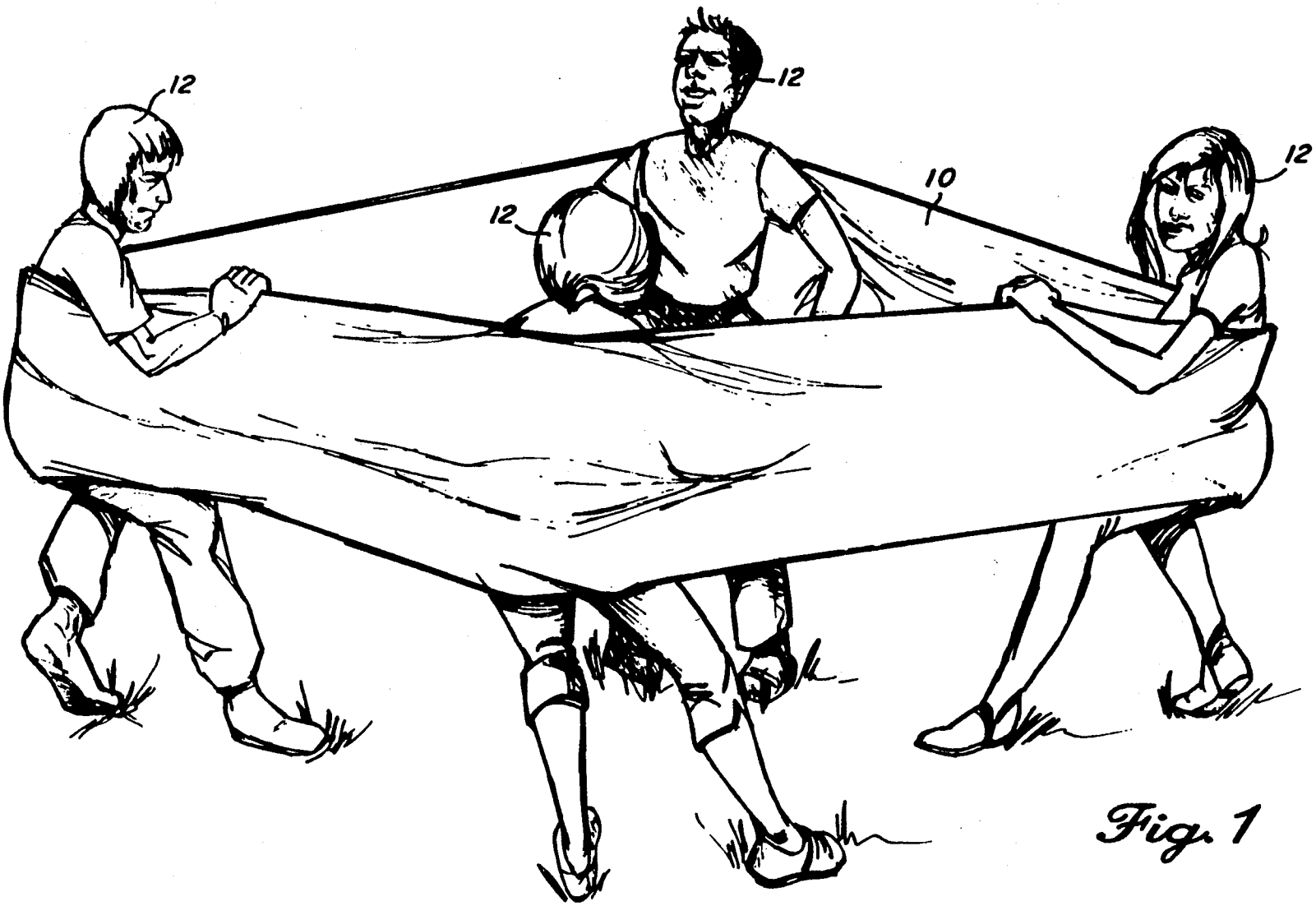
FIG. 1 shows an elastic band in accordance with the invention as in use.

FIG. 1 illustrates the elastic band 10 of the invention. The band is known as a "Bazoomie Band", and the forceful action of the band as "bazooming". It is to be noted that the word "band" is used herein as in "rubber band", and represents a simple loop which, preferably, should not be twisted in any way. The band 10 is a giant loop, constructed of a very strong, highly resilient material; i.e., having a relatively low stretch modulus of elasticity or Young's modulus. This material would be, preferably, a fabric containing fibers composed of a long-chain synthetic polymer of at least 85% of a segmented polyurethane; such fibers, the material being known as "SPANDEX". As used in an action game, the width of the band 10 should be less than the length of the body of a player 12, but should be sufficient to be retained in place by the torsos of the players 12 without rolling up laterally. The preferable range is from one foot to four feet in width. The possible length or circumference of the band 10 is more variable, but should be sufficient to allow a number of players to stand within the band and move across to another position with considerable freedom and safety, and also to maximize the resiliency of the band. The circumference of the band should, therefore, be from 5 yards to 12 yards; preferably, between six and nine yards in length. It is to be noted that the drawing figures are not drawn to scale.

The band 10 can be utilized by various numbers of players 12, typically three to six at a time, standing within the band 10, positioning their bodies with their backs against the band, and tautly supporting the band. The top of the band will preferably be supported at approximately armpit level for best results, and the top edge of the band may be held by the players' hands at times for added stability and control. The players will attempt to keep the band 10 as taut as possible at all times, thus increasing the tension in the band and, accordingly, the fun of the game.

Figure 2D:
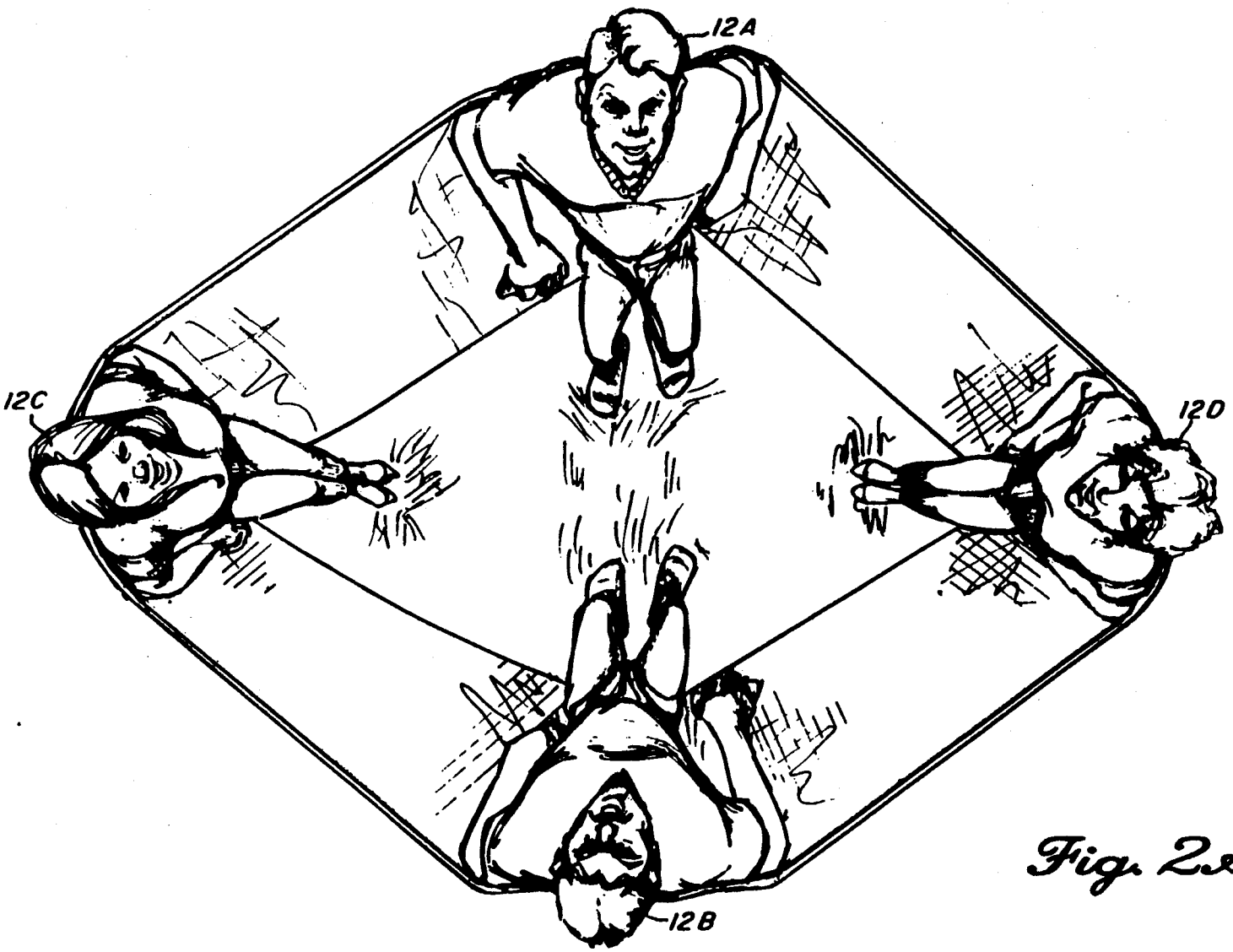
Figure 2B:
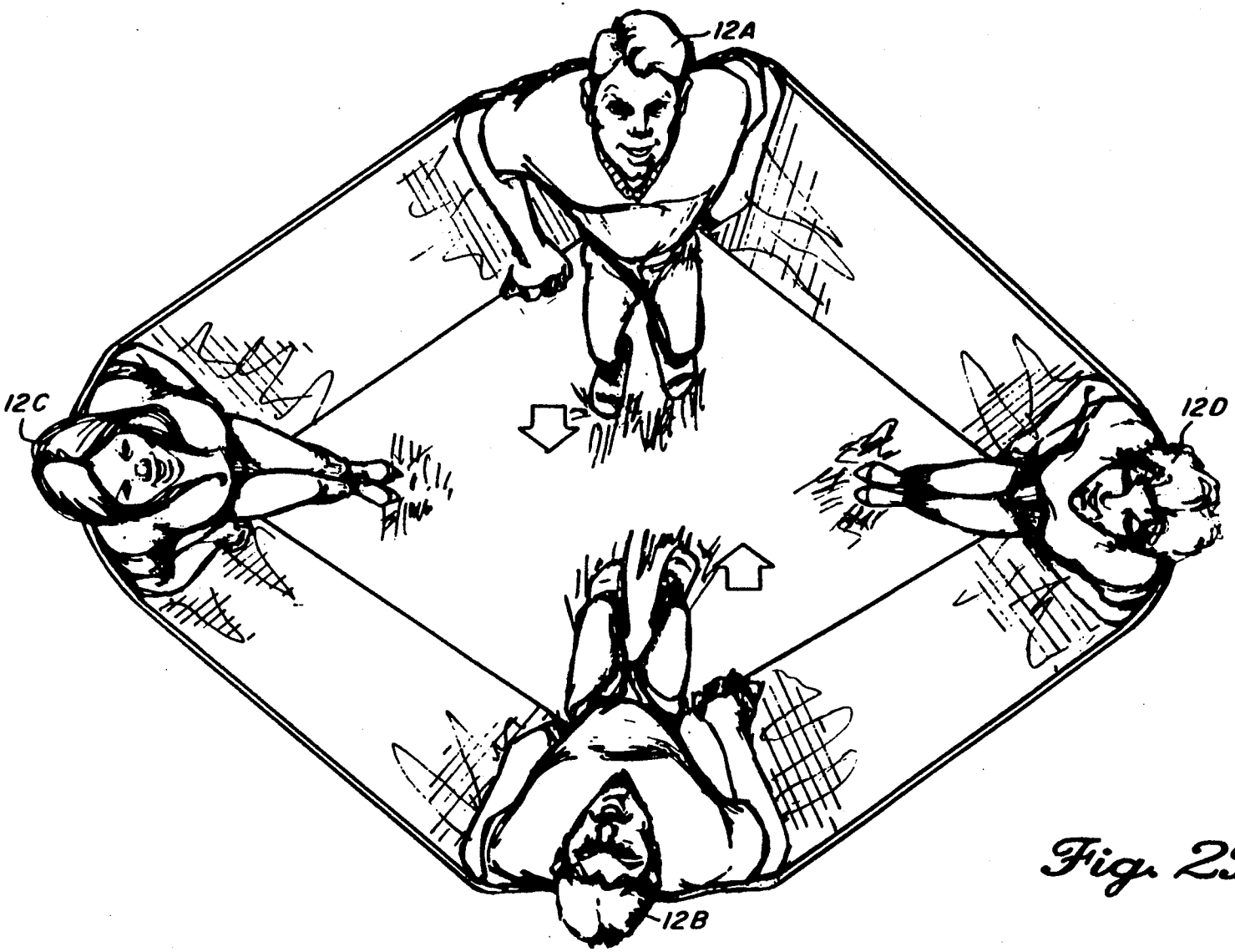
Figure 2C:
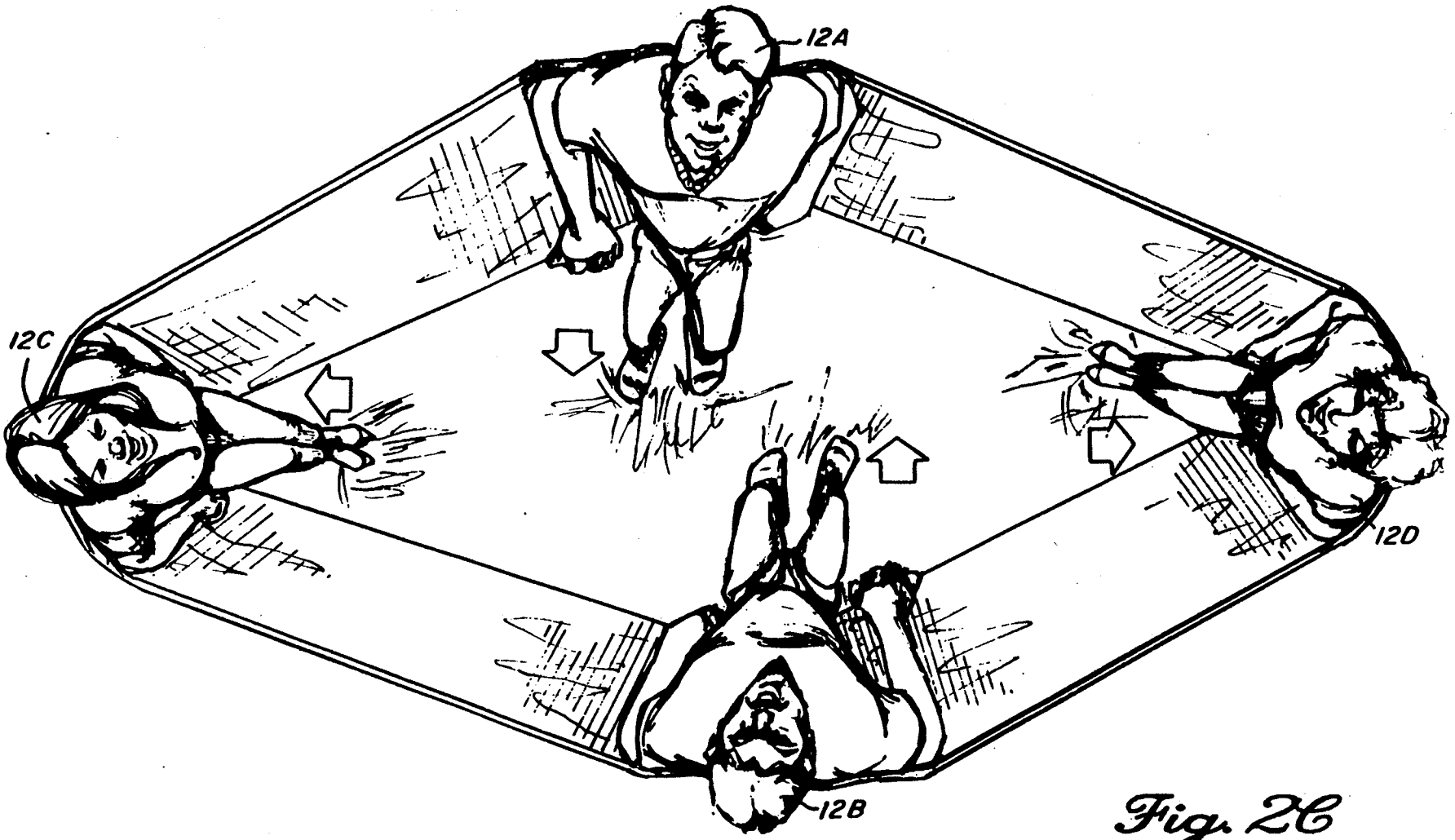
Figure 2D:
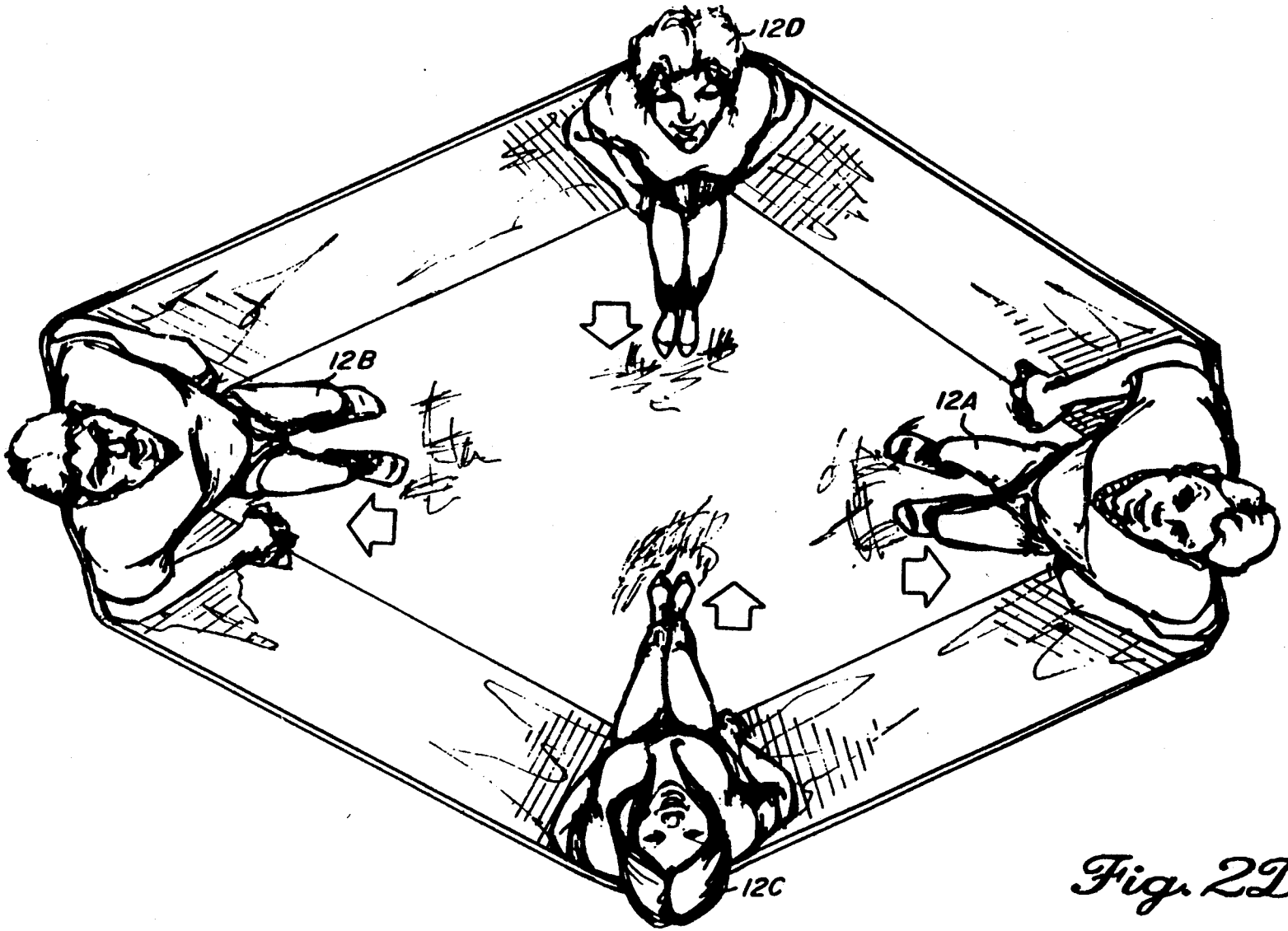
Figure 2C:
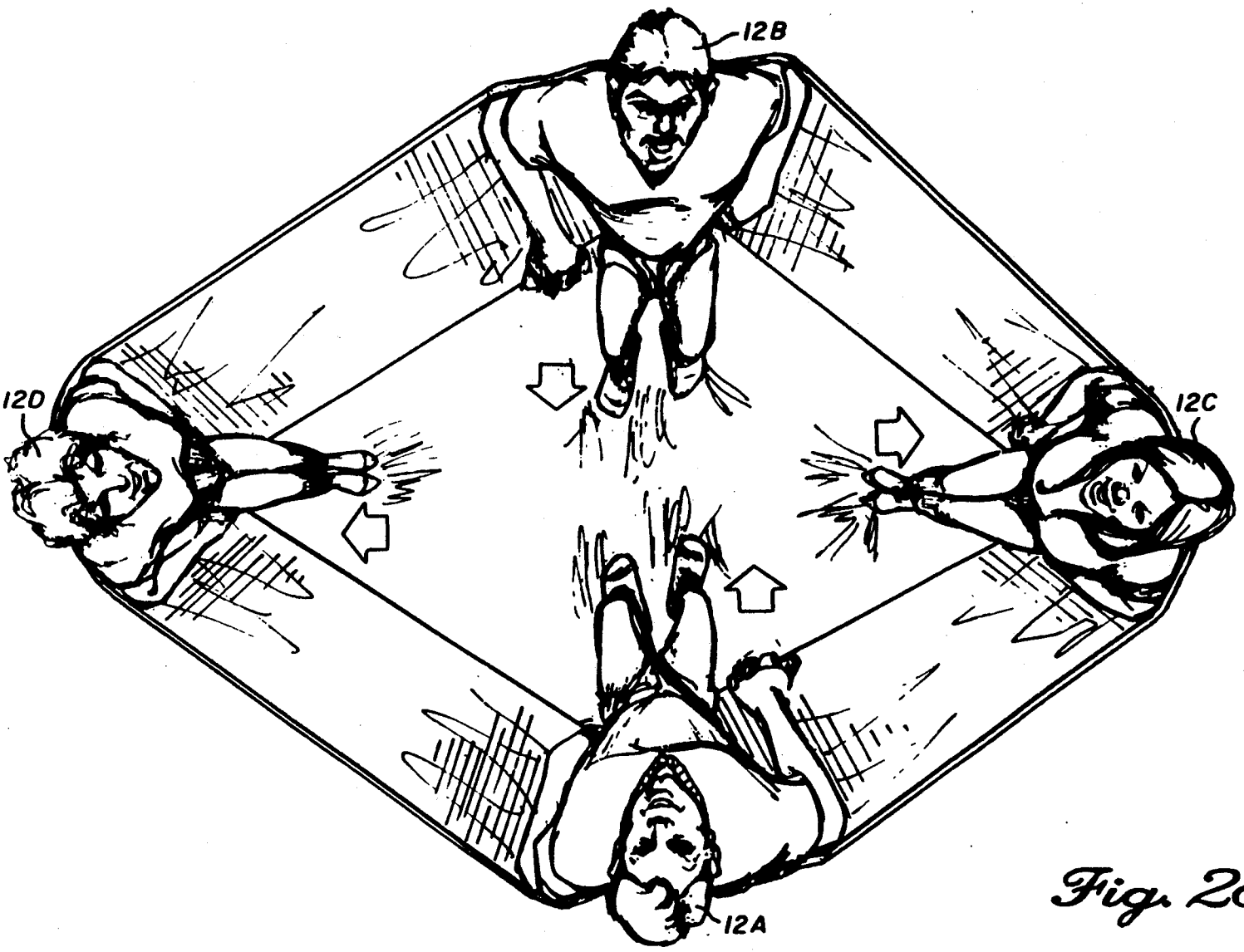

FIGS. 2A–2E illustrate, in top views, a typical game utilizing the elastic band 10 in a game involving four players 12A–12D. In FIG. 2A the starting position is seen; the players roughly forming a square with a pair of partners diagonally opposite each other; 12A opposite 12B, and 12C opposite 12D. In FIG. 2B, at a signal apparent to all players, pair 12A,12B would dart across the square, as indicated by the arrows, passing each other on the right. As seen in FIG. 2C, the second pair 12C,12D would lean or move back to support the band while the first pair 12A,12B is in motion. Each player of the pair 12A,12B will run into the band 10 at approximately the point where the respective partner started. The players should preferably hit the band with their backs for greater force and control. As the first pair collides with the opposite portions of the band, as in FIG. 2D, the second pair 12C,12D will be forced inward by the increased tension in the band and, in turn, will cross the square, and (FIG. 2E) will run into opposite portions of the band as did the first pair. The first pair 12A,12B will then repeat the crossing. This alternating procedure, and the fun, can continue until exhaustion sets in. No time constraints or scoring are necessary.

Other configurations are equally possible, depending on the number of players, and do not necessarily require pairs of players. Some variations lack the rhythmic quality of the simple game illustrated in FIG. 1, and require much more attention and coordination on the part of the players.

It will be apparent from a study of the various game possibilities of the invention that, while inexperience is no bar to enjoyment of the device, increased experience will bring increased fun and an awareness of the challenges to be met and overcome by additional skill. Since it is possible for a skilled player to better utilize the elasticity of the band 10, thus accentuating the "slingshot" effect on other players, the games can become more sophisticated in technique, escalating the excitement and competitive nature of the sport. For example, with increased experience in the various games, it may be found desirable to set a fixed time period in which players must maintain the momentum of the game, or awarding a score to the team able to maintain momentum the longest. Naturally, the more sophisticated games will require more attentiveness on the part of the players.

Figure 3:
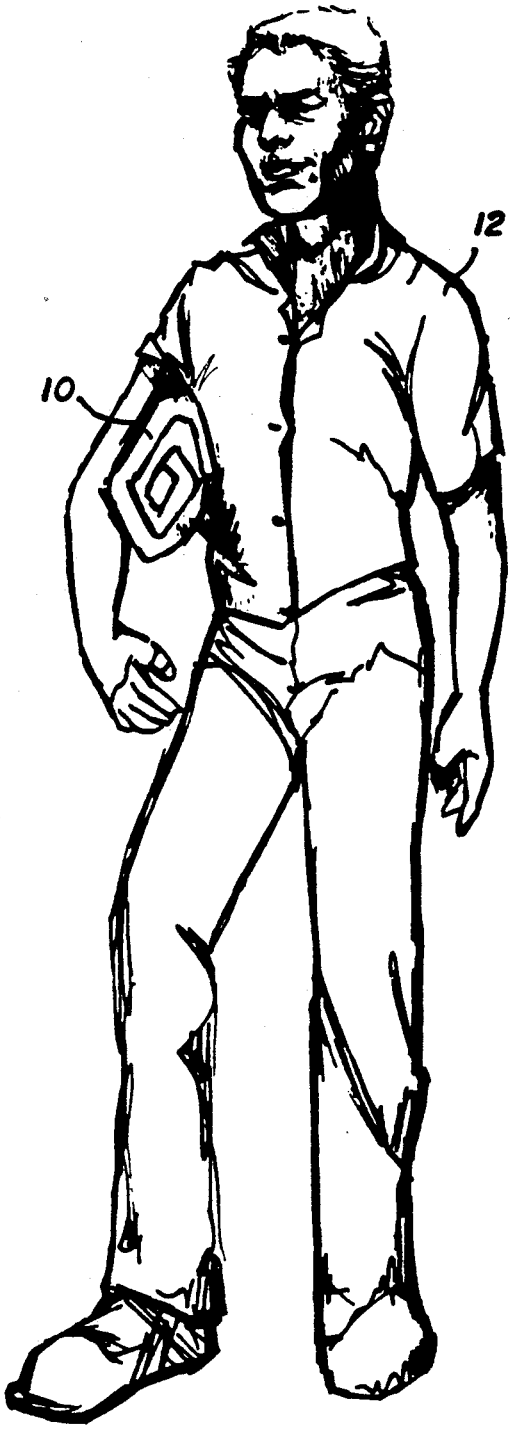
FIG. 3 is a view of the elastic band rolled up and carried with easy portability.

FIG. 3 illustrates the simplicity and portability of the game device, since the band 10 can be easily be rolled up or bundled and carried under a person's arm. Obviously, the band 10 is not fragile and there are no parts to injure a player, other than another, and inattentive, player.

There has been shown and described herein an elastic device, suitable for playing a action game involving a number of players as few as three and up to six or more. The elastic band is supported during play by the torsos of the players, with certain players leaving their positions against the band and dashing to positions across a portion of the playing area where their impact on the band forces certain others of the players to leave their positions and, in turn, be urged across the playing area and into another portion of the band. A variety of games are possible and players can create their own variations. While no skill is required for initial play, additional play will result in added skill and increased enjoyment of the device. Other variations and modifications may become apparent to the user and it is intended to cover all such as fall within the scope of the appended claims.

A guide book for use of the device of the invention is attached to this specification as Appendix A.

What is claimed is:

1. A game device for group activity comprising;

a length of a relatively flat fabric forming a simple loop;

said fabric being of an extremely strong and highly resilient quality;

said loop having a width at least one foot wide and less than the height of a player's body; and said loop having a circumference within the range of five yards to twelve yards.

2. The game device in accordance with claim 1 wherein the width of the fabric of the loop is within the range of one foot to four feet.

3. A game device in accordance with claim 1 wherein the loop is formed of a fabric containing SPANDEX fibers.

4. A game device in accordance with claim 1 wherein the loop is formed of a fabric having an elasticity similar to that of the fabric known as SPANDEX.

5. A method of playing a game utilizing a large, strong and highly resilient loop and comprising the steps of:

extending the loop to maximum size;

positioning the players within the loop and supporting the loop tautly with the players' torsos;

one or more players moving across the loop and colliding with another portion of the loop while the remainder of the players attempt to keep the loop taut; and one or more other players being subsequently propelled across the area within the loop partially due to the increased tension in the loop caused by the prior collision.

6. A method of playing a game in accordance with claim 5 wherein the play continues for a definite period of time with various players moving across the area within the loop.

7. A method of playing a game in accordance with claim 5 wherein the play continues for an indefinite period of time with various players moving across the area within the loop.

* * * * *